United States Patent [19]

Frohbieter

[11] Patent Number: 4,615,071

[45] Date of Patent: Oct. 7, 1986

[54] VACUUM CLEANER POWER DRIVE

[75] Inventor: Edwin H. Frohbieter, Lincoln Township, Berrien County, Mich.

[73] Assignee: Whirlpool Corporation, Benton, Mich.

[21] Appl. No.: 663,738

[22] Filed: Oct. 22, 1984

[51] Int. Cl.[4] ..... A47L 9/00

[52] U.S. Cl. ..... 15/340; 180/19.3

[58] Field of Search ..... 15/340; 180/19.3

[56] References Cited

U.S. PATENT DOCUMENTS

| | | | |
|---|---|---|---|
| 662,380 | 11/1900 | Mitchell . | |
| 1,152,726 | 9/1915 | Hackney . | |
| 1,229,879 | 6/1917 | Buffat . | |
| 1,317,915 | 10/1919 | Ford . | |
| 1,448,490 | 3/1923 | Moakley . | |
| 1,465,285 | 8/1923 | Peterson . | |
| 1,596,153 | 8/1926 | Chadborn . | |
| 2,814,063 | 11/1957 | Ripple | 15/319 |
| 2,950,772 | 8/1960 | Dostal et al. | 180/6.66 |
| 3,218,876 | 11/1965 | Berger | 15/340 X |
| 3,529,482 | 9/1970 | Jackson et al. | 74/197 |
| 3,613,814 | 10/1971 | Prien, Jr. | 180/19 |
| 3,618,687 | 11/1971 | Ripple et al. | 180/19 H |
| 4,011,765 | 3/1977 | Tippmann | 74/193 |
| 4,155,143 | 5/1979 | Garbe | 15/410 |
| 4,347,643 | 9/1982 | Bair, III | 15/340 |

*Primary Examiner*—Chris K. Moore

*Attorney, Agent, or Firm*—Wood, Dalton, Phillips, Mason & Rowe

[57] ABSTRACT

A vacuum cleaner having an improved power drive utilizing a ball disc transmission. In one form, the transmission is self-centering for automatic return thereof to a position wherein the wheel drive is effectively locked. The transmission is arranged to permit free wheeling when desired by suitable manipulation of the control provided for controlling the transmission. In another illustrated form, the transmission is arranged to provide free wheeling when the transmission is returned to a minimum speed arrangement. The system provides a smooth, accurately controllable power drive of the vacuum cleaner.

19 Claims, 7 Drawing Figures

FIG. 5
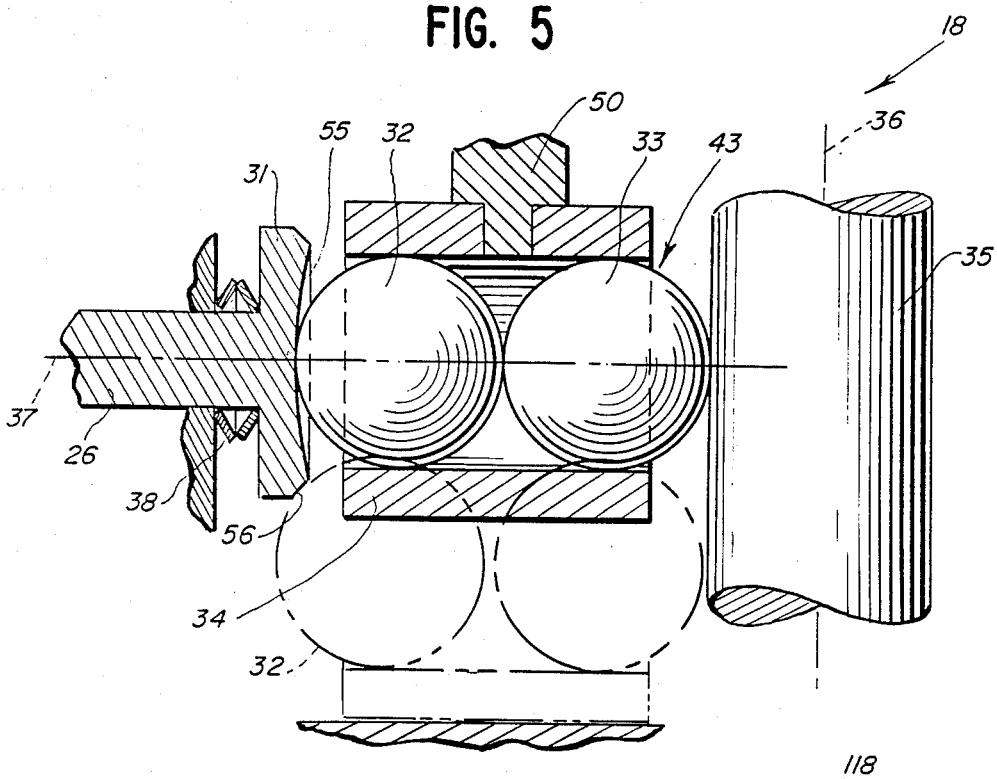
FIG. 6
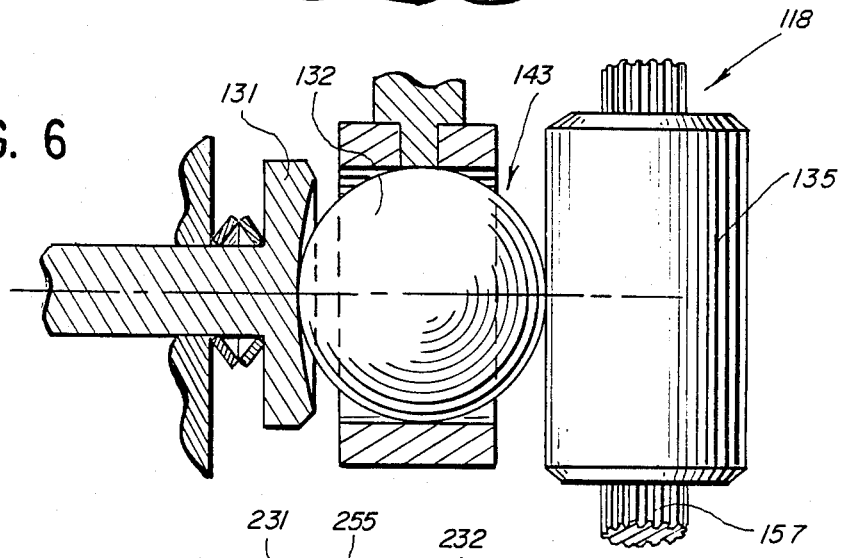
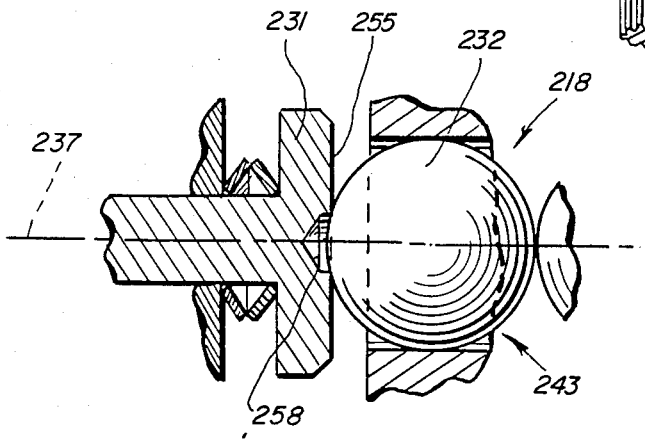
FIG. 7

VACUUM CLEANER POWER DRIVE

BACKGROUND OF THE INVENTION

1. Field of the Invention

This invention relates to vacuum cleaners and in particular to power drives for use in assisting movement of the vacuum cleaner nozzle over the surface to be cleaned.

2. Description of the Background Art

In U.S. Pat. No. 1,465,285, E. A. Peterson shows a vacuum cleaner which is power driven. A single motor is used to actuate the suction impeller, the brush, and the wheel drive. The transmission mechanism includes a reducing and reversing gear, and the brush is driven by means of a belt and pulley drive from the wheel drive.

Another electrically propelled vacuum cleaner is illustrated in U.S. Pat. No. 2,950,772 of Clara A. Dostal et al. The drive may propel the vacuum cleaner at the same speed in both the forward and backward directions, or with the forward speed greater than the backward speed, as desired. The drive assumes a neutral position when not in operation. The power drive includes at least one elastic belt and pulley and a driving motor mounted on the device.

Another example of a self-propelled suction cleaner is disclosed in U.S. Pat. No. 2,814,063, of M. H. Ripple. The structure is arranged so that substantially unconscious reactions of the operator effect the reversal of movement of the device. Additional power-driven vacuum cleaners are illustrated in U.S. Pat. No. 3,618,687 of Melvin H Ripple et al., and U.S. Pat. No. 4,347,643 of Scott S. Bair, III.

SUMMARY OF THE INVENTION

The present invention comprehends an improved self-propelled vacuum cleaner which is extremely simple and economical of construction while yet providing improved facilitated control of the movement of the vacuum cleaner by the user.

In the illustrated embodiment, the wheels of the vacuum cleaner are driven by a variable speed, ball disc drive. The drive is powered by a suitable electric motor carried by the vacuum cleaner and the motor is controlled by the user by means of a control switch carried on the upper end of the vacuum cleaner handle.

In the illustrated embodiment, the variable speed transmission is connected between the motor drive and the nozzle wheels for adjustably driving the wheels. In one form, the transmission is selectively arranged in a first position to prevent movement of the wheels, and in a second position to permit free movement of the wheels independent of the drive motor. In the intermediate positions, the drive provides a variable speed drive of the wheels.

In another form, the transmission is selectively arranged in both the first and second positions to permit free movement of the wheels independent of the drive motor.

The transmission, in the illustrated embodiment, comprises a reversible, variable speed, ball disc drive.

In one form, the ball means of the drive includes a pair of balls connected in series between the disc and the driven output element. In this form of the invention the basic transmission device is a traction drive using a constant speed input disc and a constant radius output roller. Power is transmitted between these two members by two balls in a cage which can be shifted across the input disc and along the output roller to effect the input drive radius.

In another form, the ball means comprises a single ball acting therebetween.

In one form, the disc is arranged to urge the ball means toward a neutral center position.

In one form, the ball means may be disengaged relative to the disc by outward movement beyond the periphery of the disc.

The drive system may include a slip clutch.

The control means may include means for urging the manually operable element thereof to the centered position.

As indicated above, the vacuum cleaner structure of the present invention is extremely simple and economical, while yet providing an improved, facilitated controlled power drive of the vacuum cleaner wheels.

BRIEF DESCRIPTION OF THE DRAWING

Other features and advantages of the invention will be apparent from the following description taken in connection with the accompanying drawing wherein:

FIG. 5 is an enlarged fragmentary section illustrating in greater detail the arrangement of the ball means and drive disc in the neutral position;

FIG. 6 is a fragmentary vertical section illustrating a modified form of ball disc drive embodying the invention; and FIG. 7 is a fragmentary vertical section illustrating another form of ball disc drive embodying the invention.

DESCRIPTION OF THE PREFERRED EMBODIMENTS

Figure 1:
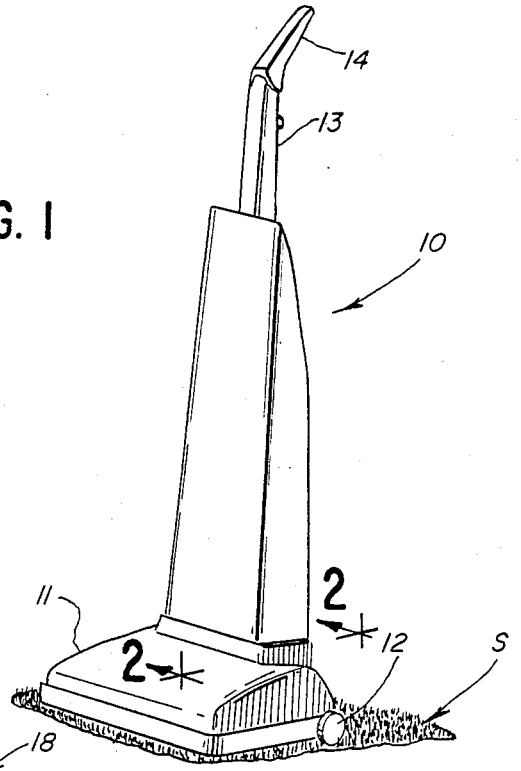
FIG. 1 is an elevation view in perspective of a vacuum cleaner having a power drive embodying the invention.

In the illustrative embodiments of the invention as disclosed in the drawing, a vacuum cleaner generally designated 10 is shown to include a nozzle 11 provided with wheels 12 for movement of the vacuum cleaner over a surface S to be cleaned.

The vacuum cleaner further includes an upright tubular handle 13 having a gripping distal portion including a movable hand grip 14 at its upper end.

Figure 2:
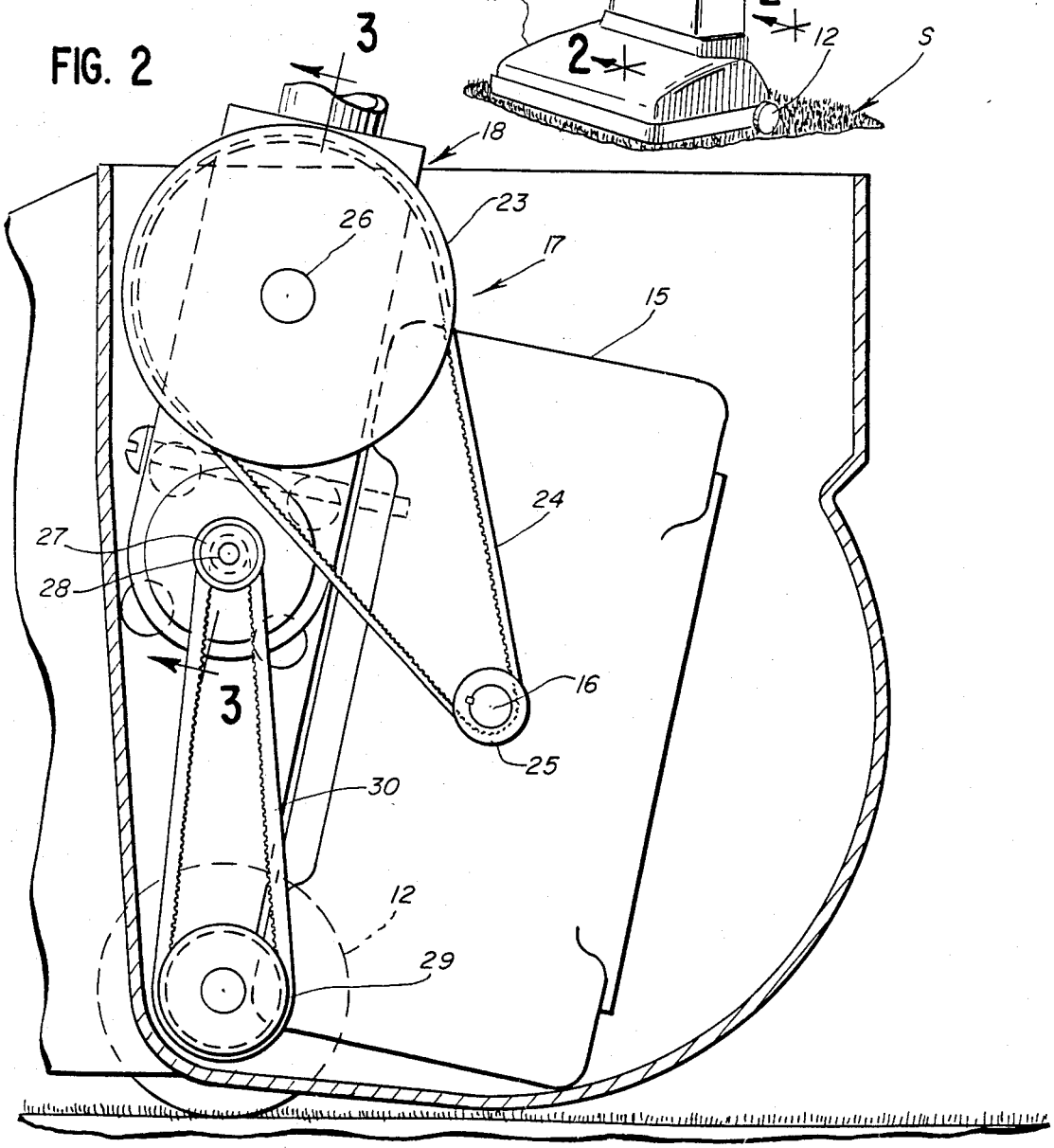
FIG. 2 is a fragmentary enlarged vertical section illustrating in greater detail the power drive mechanism.

The vacuum cleaner further includes a motor 15 (FIG. 2) having an output shaft 16. Motor 15 serves as a driver means for providing a power drive of the wheels 12, when desired. Power transfer means generally designated 17 is provided between output shaft 16 and wheels 12, and includes a variable transmission generally designated 18 for adjustably driving the wheels under control of the vacuum cleaner operator.

In the embodiment of FIGS. 1–5, the transmission 18 is selectively arranged in a first position to prevent movement of the wheels and in a second position permitting free movement of the wheels independent of the drive motor 15. The transmission provides intermediate the first and second positions variable speed drive of the wheels as desired by the user. Such speed control is provided by manipulation of hand grip 14.

For operation of the vacuum cleaner a switch 45 is pushed from "Off" to either "High" or "Low" speed position to electrically energize the fan motor 15 for either "High" or "Low" speed operation of the fan motor.

If the power drive option is to be used the hand grip 14 can be manually moved forward or rearward to push or pull a vacuum cleaner control wire 22 to provide power through the transmission 18 to drive the vacuum cleaner 10 in the selected forward or backward direction.

The hand grip 14 moves approximately 2½ inches between its extreme forward and reverse positions. A spring in the transmission urges the handle to return to the central "Neutral" position. Hand grip movement in the "forward" reverse directions is limited by the hand grip 14 abutting the hollow upright handle 13.

The hand grip 14 is attached to control wire 22 which is a solid wire encircled by nylon tubing extending throughout the tubular handle 13. The wire 22 extends down inside the handle tube to shaft 50 (see FIG. 3) to which it is fastened for controlling the transmission as will appear.

Figure 4:
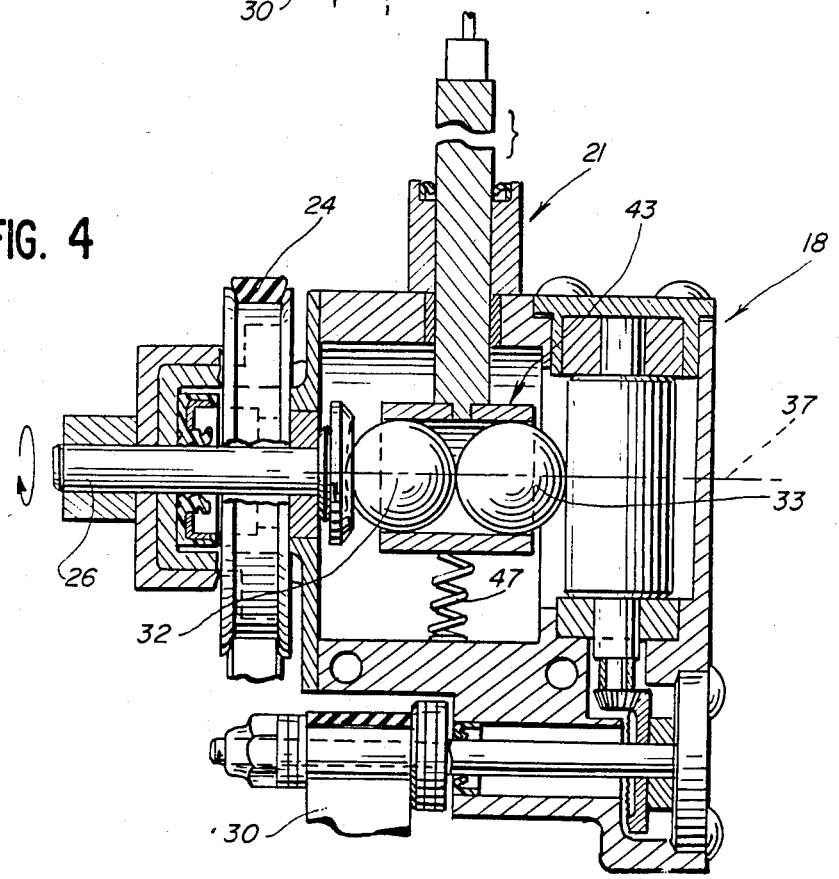
FIG. 4 is a view similar to that of FIG. 3, but illustrating the arrangement of the drive mechanism in a neutral position.

As illustrated in FIG. 4, power transfer means 17 includes a driven pulley 23 which is driven by a belt 24, in turn driven by a driver pulley 25 on drive motor shaft 16. Driven pulley 23 is mounted to an input drive shaft 26 of transmission 18.

An output pulley 27 is mounted to an output shaft 28 of transmission 18. A driven wheel pulley 29 is driven by a belt 30 from pulley 27 for power drive of wheel 12 under the control of transmission 18.

In the illustrated embodiment of FIGS. 1–5, transmission 18 comprises a ball disc drive having a drive disc 31 mounted to input shaft 26, as seen in FIG. 5. The ball force transfer means of the transmission, in the illustrated embodiment, comprises a pair of balls 32 and 33 carried in a suitable cage 34 so as to be series-mounted between disc 31 and an output driven element 35 comprising an output cylinder having its axis 36 accurately perpendicular to the axis of rotation of disc 31 and input shaft 26, as shown in FIG. 5. The transmission includes a suitable spring 47 disposed between an inside wall of the transmission housing 42 and ball cage 34 to urge the transmission to return to "Neutral" position.

Biasing means, which, in the illustrated embodiment, comprises a Belleville spring 38, illustratively having a spring rate of at least approximately 15,000 pounds per inch, is provided for urging the disc 31 coaxially through balls 32 and 33 against output cylinder 35, with a preselected frictional force to provide positive drive of the output element.

Figure 3:
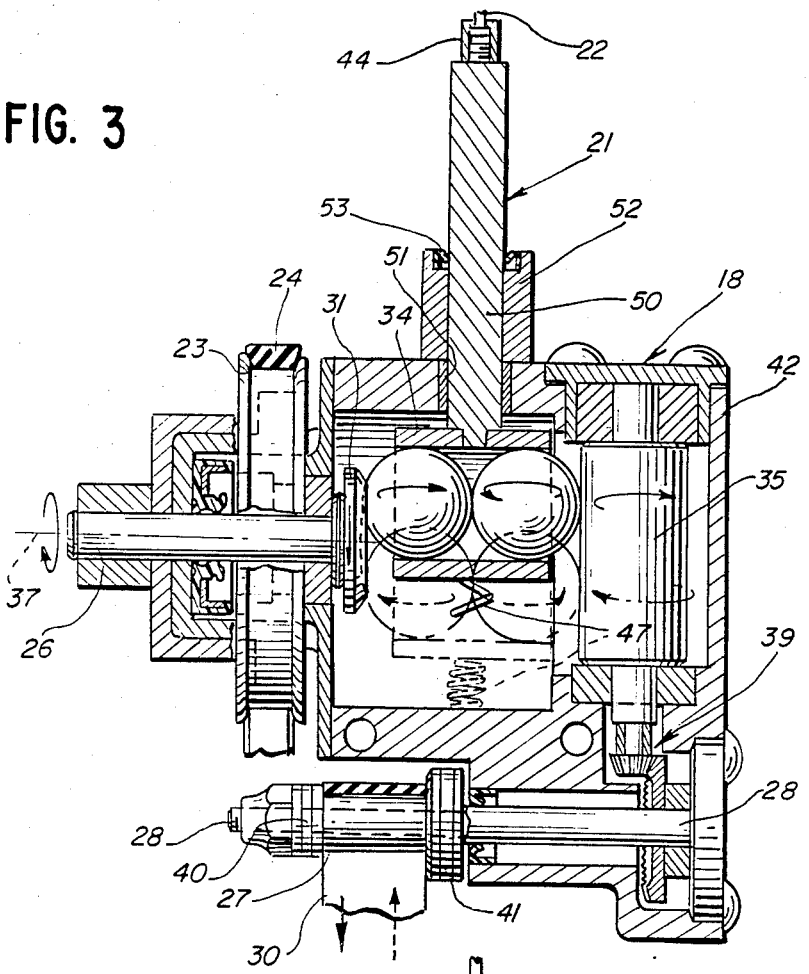
FIG. 3 is a fragmentary vertical section taken substantially along the line 3—3 of FIG. 2.

As shown in FIG. 3, the output element 35 is connected through bevel gearing 39 to the output shaft 28 carrying the wheel driver pulley 27. As shown in FIG. 3, the wheel driver pulley is connected to shaft 28 by suitable slip clutches 40 and 41 so as to prevent injury to the transmission in the event the wheels become jammed in use.

Transmission 18 is mounted within an outer housing 42 rotatively and sealingly mounting the shafts 26 and 28 and output element 35, as illustrated in FIG. 3.

Variable speed drive of output cylinder 35 from disc 31 is effected by suitable positioning of the ball means generally designated 43 under operator control through manipulation of hand grip 14. More specifically, as illustrated in FIG. 3, control wire 22 is connected by a locking collar 44 to a connector shaft 50 fixedly secured to the ball cage 34. Shaft 50 is axially slidably mounted in a suitable bearing 51 in housing 42 and a coaxial mounting hub 52 projecting outwardly from the housing and provided with a suitable seal 53.

The hand grip 14 includes a manual lock button. If the power drive option is to be used the manual lock button is positioned so that hand grip 14 can be manually moved forward or rearward to push or pull the control wire 22 to provide power through the transmission to drive the vacuum cleaner in the selected forward or backward direction. The spring 47 in the transmission attached to the ball cage urges the ball cage and the connected shaft 50, control wire 22 and hand grip 14 to return to the neutral position.

If the power drive option is not to be used, the manual lock button is positioned to lock the transmission.

Thus, movement of hand grip 14 relative to handle 13 causes selective longitudinal positioning of wire 22 and corresponding positioning of ball means 43 perpendicularly to axis 37 of input shaft 26 and disc 31, as shown in FIG. 3.

As best seen in FIG. 5, the ball-engaging surface 55 of disc 31 is frustoconical, widening outwardly from axis 37 toward ball 32 at a relatively small angle, such as approximately 1½° to the flat face of the disc (i.e. at approximately 88½° to axis 37). Thus, the action of biasing spring 38 urges the ball means 43 to the axially aligned disposition of FIGS. 4 and 5. In this position, balls 32 and 33 are effectively retained against rolling movement, thereby effectively locking the wheels 12.

However, when the ball means 43 is moved in either direction from the axial position of FIG. 4, to intermediate positions, such as shown in full lines and broken lines in FIG. 3, rolling movement of the balls 32 and 33 is effected, as illustrated by the arrows in FIG. 3, so as to effect collectively opposite rotation of the output cylinder 35, with the speed of rotation of output cylinder 35 being dependent on the amount of spacing of the balls from the disc axis 37.

Variable speed drive of output cylinder 35 is smoothly adjusted under the control of hand grip 14 from the locked position of FIG. 4 to a maximum speed position at the radially distal edge of frustoconical surface 55. It should be noted that the force exerted by biasing spring 38 increases as a direct function of the displacement of the ball means from the disc axis 37 so as to provide greater driving force at higher speeds of the wheels.

Disc 31 is further provided with a reversely beveled relief surface 56. Thus, when the ball means 43 is moved beyond the outer edge of force transfer surface 55, ball 32 will be released from driving engagement with disc 31, as shown in broken lines in FIG. 5, by its disposition in alignment with relief surface 56. Thus, in this position of the ball means 43, wheels 12 are free for movement independently of the drive system.

Referring to the embodiment of FIG. 6, a modified form of transmission generally designated 118 is shown to comprise a transmission generally similar to transmission 18, but wherein the ball means generally designated 143 includes a single ball 132 acting between the disc 131 and output cylinder 135. As shown, output cylinder 135 is axially slidably mounted to a mounting shaft 157. Other than for the above structural modifications, transmission 118 is similar to and functions similarly to transmission 18, with elements of transmission 118 corresponding to similar elements of transmission 18 identified by similar numbers but 100 higher.

A further modified and presently preferred form of transmission generally designated 218 is illustrated in FIG. 7 to comprise a transmission having a pair of balls 232 and 233, generally similar to transmission 18 but wherein the disc 231 is provided with a planar ball-engaging surface 255 having a recess 258 at disc axis 237 for freely receiving the ball 232 and thereby preventing force transmission between disc 231 and the ball means 243 when the ball means is axially aligned disposition relative to disc 231. Thus, in the axially aligned disposition, wheels 12 are free to rotate.

Transmission 218 is similar and functions similarly to transmission 18 other than for the above discussed wheel released arrangement in the axially aligned disposition. Elements of transmission 218 corresponding to elements of transmission 18 are identified by similar numbers but 200 higher.

The invention comprehends the provision of improved transmission means for effecting controlled reversible drive of the vacuum cleaner by means of the handle 14.

In one form, the transmission is self-biasing to a wheel-locking position, requiring manipulation of the handle to provide free wheeling of the vacuum cleaner when desired.

In another form, the wheel drive is effectively disconnected when the transmission is brought to a minimum speed, centered arrangement.

By moving the handle the speed of the power drive is smoothly adjustable in both directions up to a maximum speed, without jerking and binding.

Means are provided for preventing damage to the system in the event the wheels get blocked or jammed.

In the illustrated embodiment, the transmission comprises a disc ball drive. By providing for a substantial amount of control movement in effecting variable speed between minimum and maximum, improved sensitivity to the user's demands is provided.

The drive may utilize the suction motor of the vacuum cleaner, thus minimizing cost and complexity.

In one illustrative embodiment, the drive motor comprised a 17,500 rpm 0.08 HP motor, providing an operating torque through the drive wheels of approximately 14.5 In. Lb.

The power drive causes no substantial increase in noise of operation of the vacuum cleaner.

The foregoing disclosure of specific embodiments is illustrative of the broad inventive concepts comprehended by the invention.

I claim:

1. In a vacuum cleaner having a nozzle, wheels rotatably mounted to the nozzle for movement of the nozzle over a surface to be vacuum cleaned, and a handle upstanding from the nozzle, the improvement comprising:

driver means;

a variable transmission comprising a variable speed ball disc drive connected between said driver means and said wheels for adjustably driving said wheels, said transmission being selectively arranged in a first position to prevent movement of said wheels, in a second position permitting free movement of said wheels independent of said driver means, and in intermediate positions intermediate said first and second positions providing a variable speed drive of said wheels; and manually operable control means carried by said handle for selectively adjusting said transmission.

2. The vacuum cleaner structure of claim 1 wherein said control means comprises a manipulating element carried by said handle for control of the disposition of said transmission by the user of the vacuum cleaner.

3. The vacuum cleaner structure of claim 1 wherein said control means comprises a manipulating element carried by said handle and having a movement of approximately 2½" thereon for facilitated manual control of the disposition of said transmission by the user of the vacuum cleaner.

4. The vacuum cleaner structure of claim 1 wherein said transmission comprises a reversible variable speed ball disc drive, and said control means manipulating element is reversely adjustably positionable to provide reversible variable speed drive of said wheels.

5. The vacuum cleaner structure of claim 1 wherein means are provided for urging said transmission means to said first position.

6. The vacuum cleaner structure of claim 1 wherein means are provided for urging said transmission means to said first position other than when the transmission is in said second position.

7. The vacuum cleaner structure of claim 1 wherein means are provided for guiding said transmission from said second position into said intermediate positions as an incident of corresponding manipulation of said control means.

8. In a vacuum cleaner having a nozzle, wheels rotatably mounted to the nozzle for movement of the nozzle over a surface to be vacuum cleaned, and a handle upstanding from the nozzle, the improvement comprising:

driver means;

a variable ball disc transmission connected between said driver means and said wheels for adjustably driving said wheels, said transmission being selectively arranged in a first position to prevent movement of said wheels, in a second position permitting free movement of said wheels independent of said driver means, and in intermediate positions intermediate said first and second positions providing variable speed drive of said wheels, said transmission including an input disc connected to said driver means, an output element connected to said wheels, and ball means acting therebetween; and manually operable control means carried by said handle for selectively adjusting the disposition of said ball means relative to said disc.

9. The vacuum cleaner structure of claim 8 wherein said ball means comprises a first ball confronting said disc and a second ball confronting said output element, and means for urging said disc against said first ball, said first ball against said second ball, and said second ball against said output element to effect a drive transmission from said input disc to said output element.

10. The vacuum cleaner structure of claim 8 wherein said disc defines an axis of rotation and a coaxial frustoconical surface engaging and widening toward said ball means whereby said ball means is urged toward said axis of rotation by the engagement of said surface therewith.

11. The vacuum cleaner structure of claim 8 wherein said input disc defines an axis of rotation and a coaxial frustoconical surface engaging said ball means and widening away from said axis of rotation whereby said ball means is urged toward said axis of rotation by the engagement of said surface therewith, said surface extending at an angle of approximately 88½° to said axis.

12. The vacuum cleaner structure of claim 8 further including a slip clutch connected between said transmission and said wheels.

13. The vacuum cleaner structure of claim 8 wherein said ball means comprises a first ball confronting said disc and a second ball confronting said output element, and means for urging said disc against said first ball, said first ball against said second ball, and said second ball against said output element to effect a drive transmission from said input disc to said output element, said output element comprising a cylinder having a diameter substantially equal to the diameter of said ball means.

14. The vacuum cleaner structure of claim 13 wherein said urging means has a spring rate of at least approximately 15,000 pounds per inch.

15. In a vacuum cleaner having a nozzle, wheels rotatably mounted to the nozzle for movement of the nozzle over a surface to be vacuum cleaned, and a handle upstanding from the nozzle, the improvement comprising:

driver means;

a variable transmission connected between said driver means and said wheels for adjustably driving said wheels, said transmission being selectively arranged in a first position preventing movement of said wheels, and in adjusted positions providing variable speed drive of said wheels, said transmission including an input disc connected to said driver means, an output element connected to said wheels, and ball means acting therebetween; and manually operable control means carried by said handle for selectively adjusting said transmission.

16. The vacuum cleaner structure of claim 1 wherein said disc drive includes an input disc connected to said driver means, and output element connected to said wheels, and ball means acting therebetween, said disc being provided with a recess, said ball means being freely received in said recess in said second position to prevent said disc driving said ball means and thereby permit said free movement of the wheels.

17. The vacuum cleaner structure of claim 16 wherein said disc recess comprises an axial recess.

18. The vacuum cleaner structure of claim 16 further including low deflection spring means having a high spring rate biasing said disc against said ball means when the ball means is moved from said coaxial alignment with the disc.

19. The vacuum cleaner structure of claim 1 wherein said transmission includes a constant speed input disc and a constant radius output roller, a cage, and two balls in said cage, whereby power may be transmitted between said input disc and said output roller by shifting the cage across the input disc and along the output roller to adjustably affect the input drive radius.

* * * * *